United States Patent [19]

Rampe

[11] 4,301,625

[45] Nov. 24, 1981

[54] BOWL-TYPE VIBRATORY FINISHING MACHINE

[75] Inventor: John F. Rampe, Mayfield Heights, Ohio

[73] Assignee: Rampe Research, Cleveland, Ohio

[21] Appl. No.: 73,001

[22] Filed: Sep. 6, 1979

Related U.S. Application Data

[63] Continuation-in-part of Ser. No. 893,630, Apr. 5, 1978, Pat. No. 4,184,290, which is a continuation-in-part of Ser. No. 714,823, Aug. 16, 1976, Pat. No. 4,091,575.

[51] Int. Cl.[3] ..... B24B 31/06

[52] U.S. Cl. ..... 51/163.2

[58] Field of Search ..... 241/175; 51/163.1, 163.2, 51/7

[56] References Cited

U.S. PATENT DOCUMENTS

| | | | |
|---|---|---|---|
| 3,464,674 | 9/1969 | Pick | 51/163.2 |
| 3,708,918 | 1/1973 | Pool | 51/163.2 |
| 3,877,178 | 4/1975 | Campanelli | 51/163.2 |
| 4,001,979 | 1/1977 | Elkins | 51/163.2 |
| 4,042,181 | 8/1977 | Huber | 51/163.2 |

*Primary Examiner*—Harold D. Whitehead

*Attorney, Agent, or Firm*—Burge & Porter Co.

[57] ABSTRACT

A vibratory finishing machine has a bowl structure supported by elastomeric mounts, and a drive system for vibrating the bowl structure about a node point located along a vertical center axis of the bowl structure. Each of the elastomeric mounts has one portion secured to the bowl structure, and another portion secured to a base structure. The one and another portions define an axis of each mount. The mounts are located in a horizontal plane in which the node point lies and are arranged such that their axes intersect the center axis above the node point. The intersection point lies near or at the center of mass of a loaded bowl structure. The bowl structure includes a replaceable liner of simpler construction than prior replaceable liners. An adjustable eccentric weight assembly permits the gyratory characteristics of the bowl structure to be changed to meet different operating requirements. An improved unloading system includes a handle-actuated pivotal ramp member formed of a synthetic material, the ramp member having steps formed on its surface. A screen assembly includes a support structure which ensures that effective media/workpiece separation occurs.

34 Claims, 12 Drawing Figures

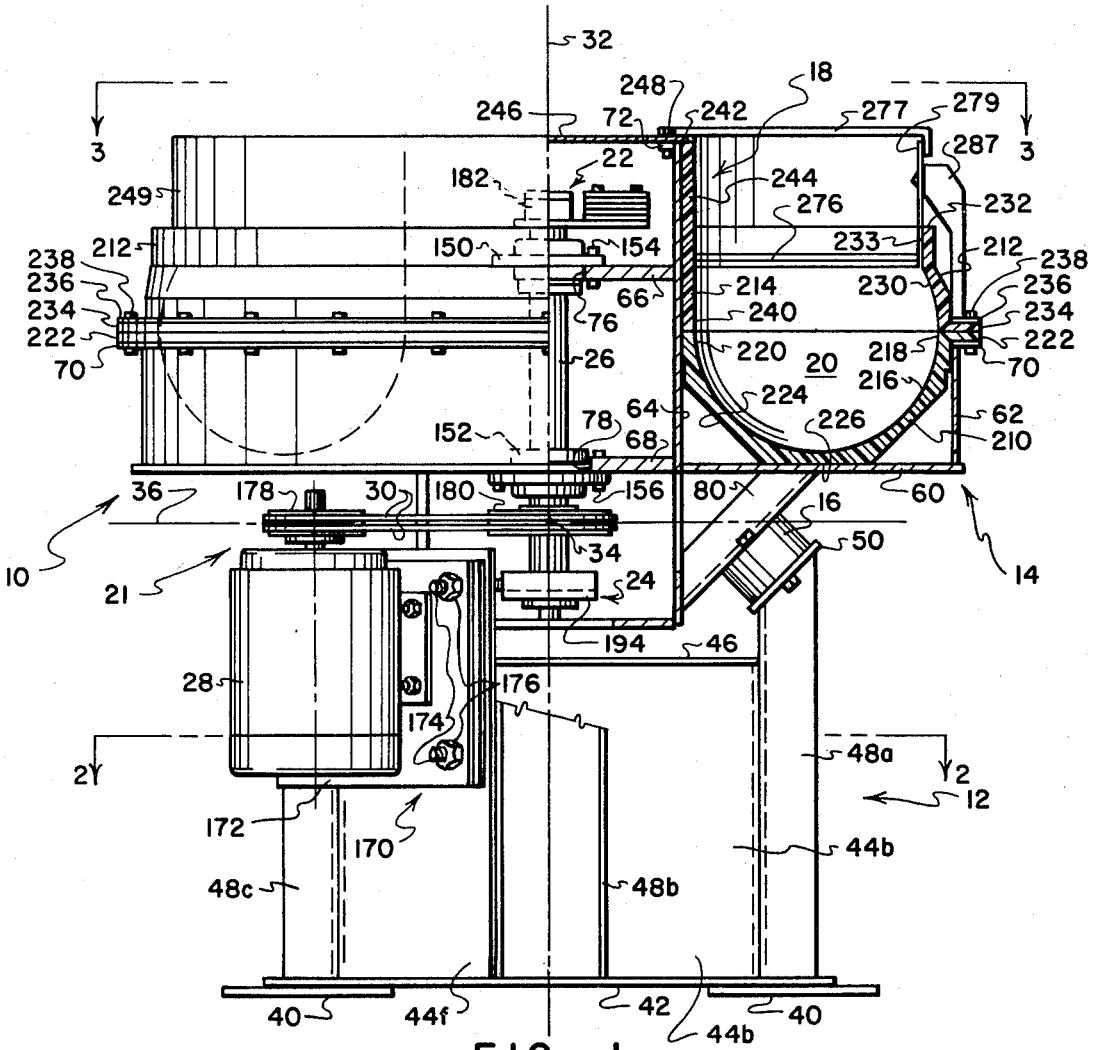
FIG. I
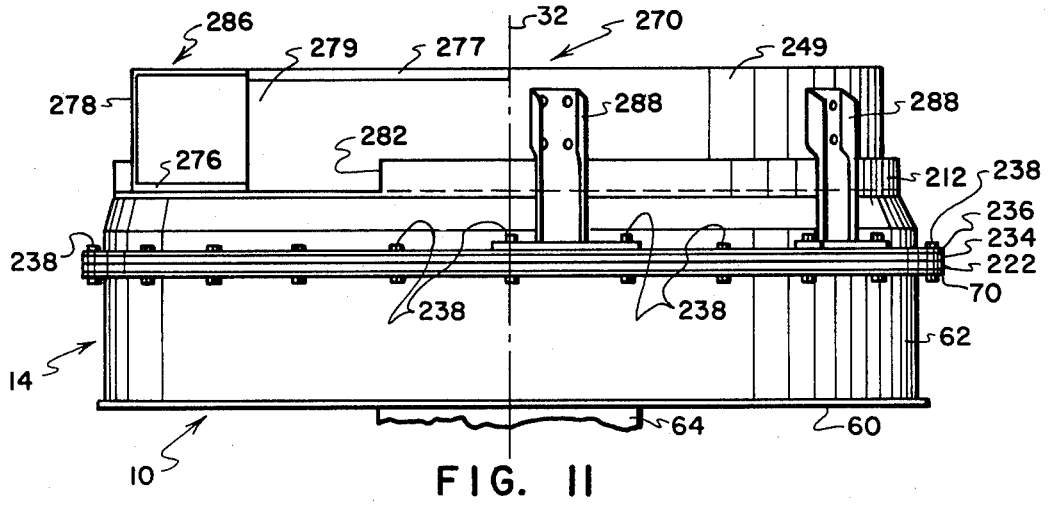
FIG. II

BOWL-TYPE VIBRATORY FINISHING MACHINE

REFERENCE TO RELATED AND RELEVANT PATENTS

The present application is a continuation-in-part of parent application Ser. No. 893,630, filed Apr. 5, 1978 by John F. Rampe, issued Jan. 22, 1980 as U.S. Pat. No. 4,184,290 (here the "Unloading System Patent"), which parent application was filed as a continuation-in-part of grandparent application Ser. No. 714,823, filed Aug. 16, 1976 by John F. Rampe, now U.S. Pat. No. 4,091,575.

"Suspension System for Bowl-Type Vibratory Finishing Machine," U.S. Pat. No. 4,090,332, issued May 23, 1978 to John F. Rampe, which patent was filed as a continuation-in-part of grandparent application Ser. No. 714,823 (the grandparent application and U.S. Pat. No. 4,090,332 being referred to here as the "Bowl Machine Suspension System Patents"), the disclosures of all the foregoing patents being incorporated herein by reference.

BACKGROUND OF THE INVENTION

1. Field of the Invention

The present invention relates generally to vibratory finishing machines, and, more particularly, to a novel and improved bowl-type vibratory finishing machine.

2. Prior Art

Many surface finishing operations such as deburring, burnishing, descaling, cleaning and the like can be conducted expeditiously in a vibratory finishing machine. Such a machine includes a movably mounted receptacle and a drive system for vibrating the receptacle. Workpieces to be finished are loaded into the receptacle together with finishing media. A finishing action is imparted to the workpieces by vibrating the receptacle so that the mixture of workpieces and media is effectively maintained in a fluid or mobile state with smaller components of the mixture dispersed between large components for impact. Impulse forces imparted to the mixture not only cause repeated impacts among its components but also cause the mixture to churn in a predictable manner as a finishing process is carried out.

Two basic types of vibratory finishing machines are in common use. One type employs an elongate, substantially horizontally disposed receptacle which is vibrated by eccentrics rotating about horizontal axes paralleling the length of the receptacle. This first type of machine is known in the art as a "tub-type machine" or simply "tub machine," and its receptacle is commonly called a "tub." Another type uses a substantially annular receptacle which is vibrated by rotating one or more eccentrics about a vertical "center axis" located centrally of the receptacle when the receptacle is at rest. This latter type of machine is known in the art as a "bowl-type machine" or simply "bowl machine," and its receptacle is commonly called a "bowl." While tub and bowl machines have many similar characteristics, they are sufficiently different in arrangement and operation that one will frequently offer advantages over the other in solving a particular finishing problem. The present invention relates to bowl-type machines.

During operation of a bowl machine, the bowl vibrates in gyratory movements about a node point located somewhere along the machine's center axis. This gyratory movement subjects the bowl's contents to a complex of vertical, radial and tangential impulse components which are intended to effect a uniform dispersion of the smaller components of the workpiece and media mixture among the large components of the mixture for impact. The resultant impulses are so oriented and timed as to cause both circumferential precession of the mixture and rotation of the mixture in essentially radiating vertical planes.

Those skilled in the art maintain different and conflicting theories on where the node point should be located along the center axis. Some maintain that the node point should be located within or near a horizontal plane which includes the center of gravity of the bowl's contents. This arrangement effectively minimizes horizontal impulse components imparted to the bowl's contents and maximizes the vertical components. Others maintain that a node point location slightly below the bottom of the bowl's chamber is desirable since it gives something of a mix of vertical, horizontal and tangential components. Still others advocate higher and lower node point locations.

Those skilled in the art similarly advance different and conflicting theories on the number of eccentrics which should be used to vibrate the bowl, the locations of the eccentrics, and the relative orientations of the eccentrics where more than one is used. Still other theories obtain on how and where a drive motor should connect with the eccentrics.

Factors such as node point location, the number, location and arrangement of eccentrics, and features of the drive motor connection all intertwine to determine such other factors as:

(a) the simplicity or complexity of the machine;
(b) the ease with which the machine can be serviced and such parts as bearings replaced;
(c) the longevity of service which can be expected from the machine;
(d) the sensitivity of the machine to different bowl loadings, i.e. whether it can handle a wide range of large and small, heavy and light loads; and
(e) the type of vibratory movement which is imparted to the bowl, which, in turn, determines such things as:
  (i) the type of circulation movement which will be executed by a mixture of media and workpieces in the bowl;
  (ii) the direction and rate of precession of the mixture; and
  (iii) the effectiveness of the resulting finishing action in terms of quality and time required to carry it out.

Previous proposals made in an effort to optimize these factors have resulted in machines which are relatively complex and difficult to service. The need for frequent bearing replacement has been a continuing problem, and the construction of many such machines has made bearing replacement difficult. Most bowl machines are quite sensitive to changes in bowl loading and operate effectively only in a relatively narrow loading range.

The invention described in the referenced Bowl Machine Suspension System Patents addresses the foregoing and other problems of the prior art. These patents describe bowl-type machines having a combination of features that are unique to the industry. These machines are of simple, relatively inexpensive construction. They have a relatively simple but rugged base structure, equally simple and rugged bowl structures, and utilize highly durable elastomeric mounts to support their bowl structures on their base structures.

Significant features of the inventions described in the Bowl Machine Suspension System Patents lie in their novel arrangement of elastomeric mounts. Each mount has one portion secured to a base structure and another portion secured to a bowl structure. The one and another portions define an axis for each mount.

In accordance with one of the Bowl Machine Suspension System Patents, the mounts are arranged such that their axes intersect at a common point along the center axis of the bowl. The machine's drive system is arranged to vibrate the bowl about a node point which coincides with this common point. The arrangement of mounts assures that forces imposed on the mounts by movements of the bowl structure load the mounts in shear, i.e. in planes normal to their axes. When arranged and loaded in this manner, the mounts tend to resiliently oppose movements of the bowl structure in any mode other than about the desired node point. As a result, the machine is found to be substantially less sensitive to variations in receptacle loading than are other, previously proposed bowl-type machines. A single machine can, for example, handle bowl load volumes within as large a range as 2 cubic feet to 6 cubic feet, and is operable to impart a good finishing action to the load anywhere within this very broad range.

In accordance with the other of the Bowl Machine Suspension System Patents, certain of the mounts are arranged such that their axes intersect at a common point along the machine's center axis above the node point, while others of the mounts are arranged such that their axes intersect at another common point along the machine's center axis below the node point. Still other mounts may be provided with their axes arranged such that they intersect the machine's center axis at the node point. Such an arrangement of elastomeric mounts assists in stabilizing node point location and in reducing the sensitivity of the machine to variations in bowl loading. Additionally, the mounts are loaded principally in shear by the dead weight of the bowl structure and its contents. The invention described in the present patent differs in that it utilizes some mounts which are not loaded solely in shear by vibratory movements of the bowl structure.

Bowl machine proposals prior to the inventions described in the referenced Bowl Machine Suspension System Patents do not address the problem of stabilizing actual node point location. It is believed that the tendency of node point location to vary with changes in bowl loading explains, at least in part, the difficulty prior proposals have encountered in providing machines that will handle a wide range of bowl loadings. If the actual location of the node point about which a bowl structure moves is displaced from the location for which the machine was designed, the machine operates inefficiently, if at all, and causes excessive wearing of drive and suspension system components.

Another problem of bowl-type machines relates to the linings used to cover the inner surface of the bowl structure. Whereas tub machines have elongate tubs of relatively simple configuration, bowl machines have relatively complex, toroidal-shaped bowls. Molding a replaceable, torus-shaped liner is difficult and expensive. Many bowl machine proposals use a cast-in-situ liner which requires extensive machine disassembly and replacement of the bowl shell when a liner is to be changed. The expense and effort and lengthy downtime required to replace bowl machine liners is, in fact, one of the major drawbacks which influence purchasers to buy a tub-type machine when a bowl-type machine might better serve their needs. Accordingly, it is important in any acceptable bowl-type machine that a relatively easily formed, easily replaceable liner be used.

The eccentric drive systems utilized in the referenced Bowl Machine Suspension System Patents provides for the removable mounting of a plurality of eccentric weight members. If the radial orientation of the weight members relative to the shaft required changing, the mounting arrangement required a mechanical repositioning of a weight support arm relative to the drive shaft. Desirably, the drive system would permit relatively easy repositioning of a weight relative to the drive shaft.

Yet another consideration of bowl-type machines relates to the technique by which the bowl structure is unloaded. Certain prior proposals have called for the use of a removably positioned ramp to direct a mixture of finishing media and workpieces onto a screen which overlies the bowl. The screen effects separation of the finishing media from the workpieces. As the workpieces travel across the screen for discharge, the media drops through the screen back into the bowl.

The Unloading System Patent describes and claims an effective solution to the problem of unloading the bowl. In the Unloading System Patent, the floor of the bowl is provided with a mound-shaped formation having a substantially horizontally extending top surface. A foldable ramp member is insertable into and removable from the bowl. One end of the ramp member is engageable with the mound-shaped formation and the other end of the ramp member is engageable with a channel-defining structure including a screen across which workpieces and media travel. The ramp member cooperates with the mound-shaped formation to direct finishing media and finished workpieces from the floor of the bowl upwardly into the channel. Although the Unloading System Patent describes an effective solution to the problem, it is desired to improve even more upon the simplicity and ease of operation of the assembly.

SUMMARY OF THE INVENTION

The present invention relates to a novel and improved bowl-type vibratory finishing machine including novel and improved features relating to the bowl suspension system, the bowl structure, the mounting of eccentric weights in the drive system, and an unloading system for the bowl structure.

Whereas the bowl machines described in the referenced Bowl Machine Suspension System Patents have utilized elastomeric mounts loaded principally in shear and arranged with their axes either intersecting or clustered about the node point about which the bowl structure vibrates, the present invention utilizes elastomeric mounts which are loaded both in compression and in shear and which have their axes arranged to intersect the center axis of the bowl structure at a location substantially above that of the node point. The mounts themselves are located in a horizontal plane in which the node point lies. Whereas the arrangements of elastomeric mounts utilized in the referenced Bowl Machine Suspension System Patents can be understood to operate effectively to perform a node point stabilization function and can readily be understood to enhance machine operating characteristics, it is "unexpected," to say the least, that significant advantages in machine operating characteristics should result from the relatively unorthodox arrangement of suspension system mounts utilized in the present invention. While the teachings of the referenced Bowl Machine Suspension System Patents tend to indicate that all mount axes should intersect at or near the machine's node point for the machine to be operable, the present invention presents a significant departure from this approach and yet provides a machine which is desirably insensitive to variations in bowl loading.

While the replaceable liner assembly described in the referenced Bowl Machine Suspension System Patents provides an annular, toroidal-shaped chamber, and while the described chamber functions well to churn and precess a mixture of media and workpieces, it has been discovered that a replaceable inner extension member included as part of the liner assembly can be simplified without adversely affecting performance. Specifically, the bowl structure includes a vertically extending, cylindrical center tube about which the inner extension liner member is placed. In certain prior bowl-type machines, the inner extension member was configured on its exposed surface such that an arcuate curve created by the lowermost tub liner member was extended. This required the molding of complexly configured surfaces. The present invention employs an inner extension member having a vertically oriented sidewall which breaks the arcuate curve created by the lower tub liner member. This construction is far simpler and less expensive than prior configurations, but it has been found to function as well as prior configurations.

The invention also contemplates an improved mounting of eccentric weights in a drive system. A vertically oriented drive shaft employs an upper eccentric weight assembly including a plate keyed to the shaft by a hub. The plate includes a plurality of openings by which a number of weights can be secured to the plate by threaded fasteners. The openings in the plate permit the weights to be placed in any of a desired number of different radial locations with respect to the shaft. Because the upper eccentric weight assembly is easily accessible to the user, the position of the weights with respect to the shaft and, hence, the gyratory characteristics of the bowl structure, can be changed readily to accommodate different operating requirements. In an alternate embodiment of the upper eccentric weight assembly, a circumferential plate is employed, the plate having a greater number of openings at a number of radial locations to permit weights to be placed at any desired circumferential location.

The invention also includes an improved unloading system for the bowl structure. Like the unloading system described in the Unloading System Patent, the present invention employs a mound-shaped formation in the floor of the bowl. Unlike the unloading system on the Unloading System Patent, the present invention employs an actuating mechanism for moving a ramp member. In accordance with the present invention, the ramp member includes a rectangular plate-like structure having a coating of synthetic material. The ramp includes a shaft supported at one end adjacent the center tube and extending at the other end through an opening in the outer wall of the bowl structure. The outer end of the shaft includes a flexible handle engageable with a locking clip. Upon flexing the handle to an unlocked position, the ramp can be pivoted downwardly into engagement with the mound-shaped formation so that media and workpieces will advance upwardly to a screen where separation will occur. After the tub has been emptied of workpieces, the handle can be raised to pivot the ramp member to a rest position, whereupon the handle can be engaged with the clip to lock the ramp member in the rest position. The described unloading system provides an effective and simple technique to unload the bowl. The outer surface of the mound-shaped formation and the ramp member is configured such that media and workpieces always are urged upwardly toward the screen. The screen itself includes a mounting assembly configured such that media and workpieces always are directed onto the screen, rather than toward the edges of the screen. The unloading system includes an effective technique by which screens can be removed and replaced.

It is a general object of the present invention to provide a novel and improved bowl-type vibratory finishing machine.

It is another object to provide a bowl-type vibratory finishing machine having an improved suspension system.

It is still another object to provide a bowl-type finishing machine which is relatively insensitive to variations in bowl loading.

It is a further object to provide a bowl-type vibratory finishing machine having a novel and improved arrangement for mounting eccentric weights in a plurality of predetermined radial positions.

It is a further object to provide an improved liner assembly for a bowl-type vibratory finishing machine such that manufacturing expense is reduced.

It is still another object of the present invention to provide a bowl-type vibratory finishing machine having an unloading system with a simple, strong control mechanism accessible entirely from outside the bowl structure.

It is yet another object of the present invention to provide a bowl-type vibratory finishing machine having an unloading system wherein screens may be removed and replaced readily, and wherein a support system for the screens always directs media and workpieces onto the screens.

These and other objects and a fuller understanding of the invention described and claimed in the present application may be had by referring to the following description and claims taken in conjunction with the accompanying drawings.

BRIEF DESCRIPTION OF THE DRAWINGS

FIG. 1 is a side elevational view of a bowl-type vibratory finishing machine embodying the preferred practice of the present invention, the view having portions broken away and shown in cross-section;

FIG. 11 is a side elevational view of portions of the machine of FIG. 1 as seen from a plane indicated generally by a line 11—11 in FIG. 3; and, FIG. 12 is a schematic representation of the suspension system employed in the machine of FIG. 1.

DESCRIPTION OF THE PREFERRED EMBODIMENT

Figure 3:
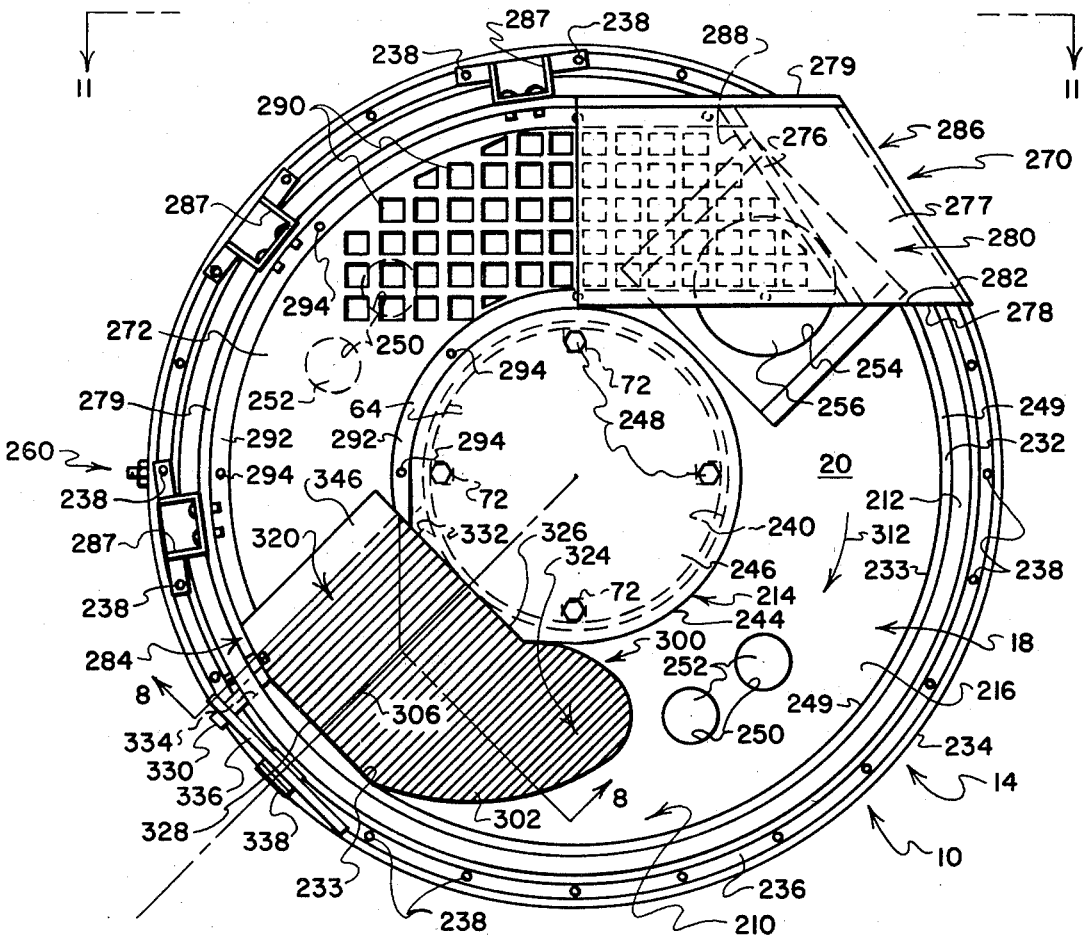
FIG. 3 is a top plan view of the machine of FIG. 1.

Referring to FIGS. 1 and 3, a vibratory finishing machine is indicated generally by the numeral 10. The machine 10 includes a base structure 12 and a bowl structure 14. Elastomeric mounts 16 resiliently interconnect the structures 12, 14 and permit relative movement therebetween. A replaceable liner assembly 18 forms part of the bowl structure 14 and defines an annular finishing chamber 20 for receiving media and workpieces to be finished. Vibratory movements are imparted to the bowl structure 14 by a drive system 21 which includes upper and lower eccentric weight assemblies 22, 24 supported on opposite ends of a rotatable shaft 26, a motor 28, and belts 30 which drivingly interconnect the shaft 26 and the motor 28.

The machine 10 has a "center axis", indicated by the numeral 32. The center axis 32 is an imaginary vertical line defined by the axis of the shaft 26 when the machine 10 is at rest. The center axis 32 extends substantially coaxially of the trough or chamber 20. During operation of the machine 10, the bowl structure 14 vibrates substantially about a node or null point 34. The node 34 is located at the juncture of the center axis 32 and a horizontally extending "nodal plane" 36. As will be appreciated by those skilled in the art, in actual practice the node point 34 is not a mathematical point but rather should be considered to be a small region around the juncture of the center axis 32 and the nodal plane 36. Depending on such variables as the position of the center of gravity of the bowl structure 14 and its contents, the node point 34 may be located a small distance above or below the nodal plane 36. Due to a number of factors including the fact that the bowl structure 14 need not be accurately balanced, the actual node point 34 may oscillate through small distances about the juncture of the center axis 32 and the nodal plane 36. As will be explained, the elastomeric mounts 16 serve to stabilize the location of the actual node point.

Figure 2:
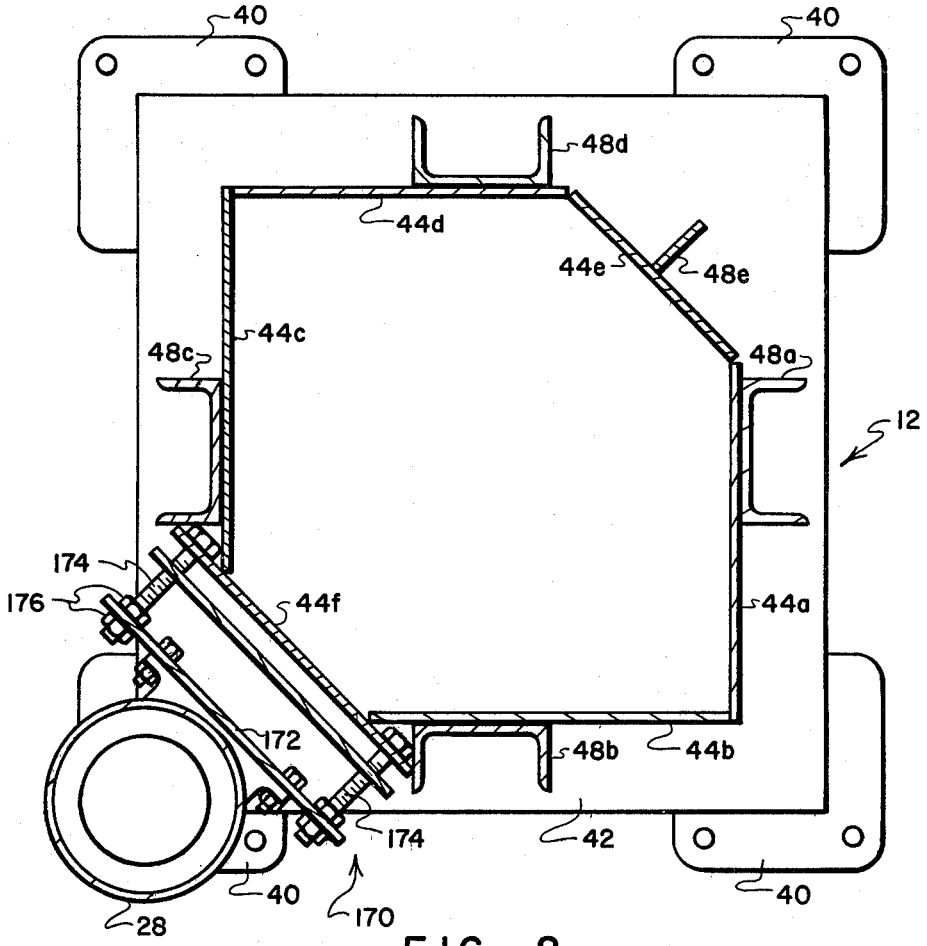
FIG. 2 is a sectional view as seen from a plane indicated generally by a line 2—2 in FIG. 1.

Referring to FIGS. 1 and 2, the base structure 12 has a welded framework including four feet 40, a bottom wall 42, side wall members 44*a*, 44*b*, 44*c*, 44*d*, 44*e*, 44*f*, a top wall 46, and side wall bracing channels and ribs 48*a*, 48*b*, 48*c*, 48*d*, 48*e*. The feet 40 are welded to the underside of the bottom wall 42 and support the machine 10. The bottom wall 42 is a square plate which is welded to the side wall members 44*a*–44*f* and to the bracing members 48*a*–48*e*. The side wall members 44*a*–44*f* extend substantially vertically and adjacent ones of these members are welded together to form a rigid structure. The top wall 46 is of irregular hexagonal configuration and is perimetrically welded to the side wall members 44*a*–44*f*. The bracing members 48*a*–48*e* are each welded to a separate one of the sidewall members 44*a*–44*e*. The channel members 48*a*, 48*b*, 48*c*, 48*d* extend upwardly beyond the top wall 46 and have inclined mounting plates 50 welded to their upper ends. The mounting plates 50 are inclined relative to the horizontal at equal angles, preferably within the range of about 30 to 60 degrees, 45 degrees being the preferred angle of inclination.

Referring to FIGS. 1, 3 and 11, the bowl structure 14 has a welded framework including a bottom wall 60, a side wall 62, an upstanding center tube 64, and a pair of bearing mounting plates 66, 68. The bottom wall 60 is of annular configuration and is perimetrically welded to the side wall 62. The side wall 62 is of cylindrical configuration, extends upwardly from the bottom wall 60, and has a laterally extending rim 70 affixed to its upper periphery. The center tube 64 extends centrally through and is welded to the bottom wall 60. The bottom of the center tube 64 is spaced a small distance from the upper surface of the top wall 46. A plurality of radially inwardly extending tabs 72 are affixed to the upper end region of the center tube 64. The bearing mounting plates 66, 68 are of annular configuration, are welded to the center tube 64, and have central openings 76, 78, respectively. Inclined mounting brackets 80 are welded to the lower end of the center tube 64 and to the underside of the bottom wall 60.

Figure 12:
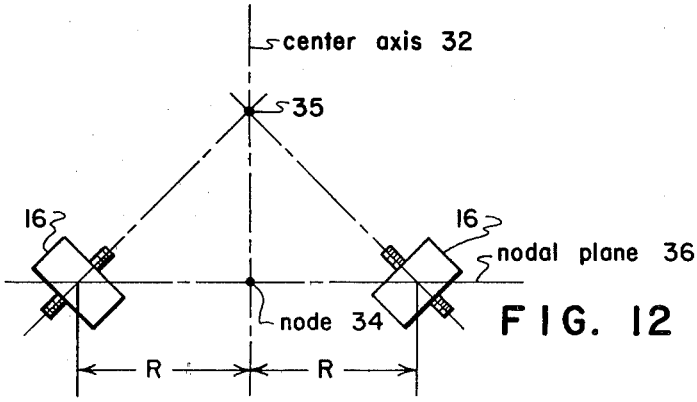

The elastomeric mounts 16 are four in number, each mounted on a separate one of the mounting plates 50, and each having its inner end mounted on a separate one of the brackets 80. The mounts 16 are preferably of a type sold by Lord Corporation, Erie, Pennsylvania, 16512, Part Number J5682-22, and have a spring rate of $K_s$=550 pounds per inch and $K_c$=4400 pounds per inch. Referring to FIG. 12, the mounts 16 have axes which extend through and intersect the center axis 32 at a point 35 above the node point 34. The node point 34 lies in a horizontal plane denominated the nodal plane 36. The mounts 16 all are located at equal radial distances from the center axis 32, as indicated by the dimensions "R", and at least a portion of each mount 16 lies in the nodal plane 36. In preferred practice, the center of mass of each mount 16 lies in the nodal plane 36. The mounts 16 also are located at equidistant radial locations relative to the center axis 32.

Since the axes of the mounts 16 are inclined relative to the horizontal, the mounts 16 support the dead weight of the bowl structure 14 and its contents by both shear and compression loadings. Since the axes of the mounts 16 intersect above the node point 34, loads imposed on the mounts 16 by movements of the bowl structure 14 about the node point 34 impart both shear and compression loadings to the mounts 16. The fact that the mount axes do not pass directly through the node point 34 causes the mounts 16 to experience cyclical compressive and tensile strains as the bowl structure 14 moves about the node point 34. Inasmuch as the mounts 16 strongly resiliently oppose being compressed and stretched in axial directions, they tend to confine movements of the bowl structure 14 to a mode where axial compressions and extensions of the mounts 16 are minimized. The described arrangement of mounts operates to confine movements of the bowl structure 14 to points about the center axis 32. Depending on the mass and arrangement of the load of parts and media in the bowl structure 14, the actual node point 34 may be higher or lower than the location illustrated in FIGS. 1 and 12.

An operating characteristic of the described suspension system is that it stabilizes the location of the actual node point 34 about which the bowl structure 14 vibrates by tending to confine the node point 34 to a location along the center axis 32. Confining the movements of the bowl structure 14 in this manner is found to reduce the sensitivity of the machine 10 to variations in finishing chamber loading. The operating characteristics of this suspension system are unlike those of previously proposed suspension systems including those described in the referenced Bowl Machine Suspension System Patents, and the suspension system of the present invention maintains a substantially constant node location to reduce sensitivity to variations in finishing chamber loading.

Referring again to FIG. 1, the shaft 26 included as part of the drive system 21 is journaled by two bearing block assemblies 150, 152. The bearing assembly 150 extends through the mounting plate opening 76 and is secured to the mounting plate 66 by threaded fasteners 154. The bearing assembly 152 extends through the mounting plate opening 78 and is secured to the mounting plate 68 by threaded fasteners 156. The motor 28 is movably supported by a mount, indicated generally by the numeral 170. The mount 170 includes a bracket 172 supported on threaded bolts 174. The bolts 174 extend through aligned holes formed in the side wall member 44*f* and the bracket 172. The heads of the bolts 174 are welded to the side wall member 44*f*. Nuts 176 clamp opposite sides of the bracket 172 to position it. The motor 28 is secured to the bracket 172.

Referring to FIG. 1, a twin pulley 178 is carried on the drive shaft of the motor 28. A twin pulley 180 is secured to the lower end region of the shaft 26. A pair of belts 30 are reeved around and drivingly interconnect the pulleys 178, 180. The belts 30 are operable to drive the shaft 26 at a speed of about 1200 revolutions per minute. A feature of the machine 10 is that the pulleys 178, 180 and the drive belts 30 are located quite near to if not within the nodal plane 36. This arrangement minimizes movements of the pulley 180 with respect to the pulley 178 during machine operation and thereby overcomes problems of excessive belt wear, belt stretching, belt slipping, and belt throwing encountered in operating some previously proposed bowl machines.

Figure 4:
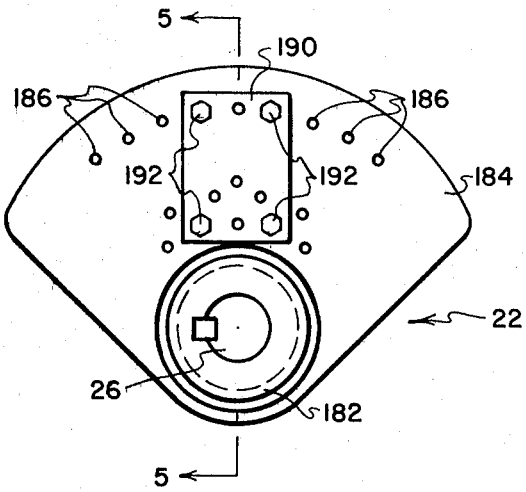
FIG. 4 is an enlarged top plan view of an eccentric weight assembly utilized in the machine of FIG. 1.
Figure 5:
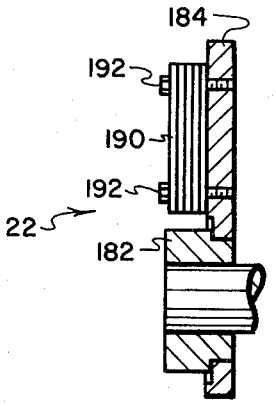
FIG. 5 is a sectional view as seen from a plane indicated by a line 5—5 in FIG. 4.

Referring to FIGS. 4 and 5, the upper eccentric weight assembly 22 includes a hub 182 keyed to the shaft 26 so that movement of the hub 182 with respect to the shaft 26 is not possible. A plate-like sector 184 is rigidly secured to the hub 182. The sector 184 subtends an arc of about 90 degrees. The sector 184 includes a plurality of threaded openings 186 by which a plurality of removable weights 190 can be held in place by threaded fasteners 192. The weights 190 can be added and removed as required to accommodate exceptionally large or small loads of workpieces and finishing media and to adjust the machine 10 for optimal operation within the loading range most commonly used for a particular finishing operation.

The lower eccentric weight assembly 24 is in the form of a rectangular plate 194 keyed to the shaft 26. A plurality of weights (not shown) are secured to the plate 194 by threaded fasteners (not shown). As with the upper eccentric weight assembly 22, weights can be added and removed as required to accommodate various operating requirements. Because the lower eccentric weight assembly 24 is positioned beneath the bowl structure 14, it is relatively inaccessible and it is expected that its weights will be changed rarely, if ever, under normal conditions of use of the machine 10.

Typically, the shaft 26 will be rotated counterclockwise when viewed from above and the lower eccentric weight assembly 24 will lead the upper eccentric weight assembly by 90 degrees. The threaded openings 186 permit the weights 190 to be moved from place to place on the sector 184, thereby changing the effective angular relationship between the upper and lower eccentric weight assemblies 22, 24. Changing the angular relationship between the upper and lower eccentric weight assemblies 22, 24, like adding or subtracting weights, can greatly affect the operating characteristics of the machine 10, and this feature of the invention permits the machine 10 to be "tuned" to process effectively whatever kind of workpiece is in the bowl structure 14.

Figure 6:
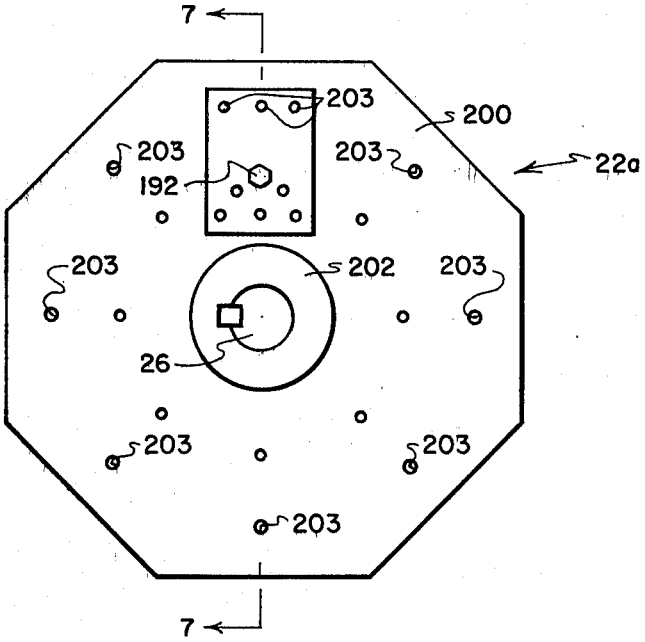
FIG. 6 is a top plan view of an alternate eccentric weight assembly utilized in the machine of FIG. 1.
Figure 7:
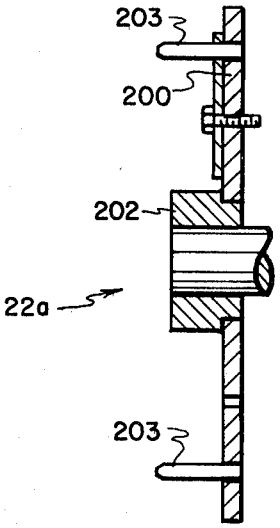
FIG. 7 is a sectional view as seen from a plane indicated by a line 7—7 in FIG. 6.

Even greater versatility is provided by an alternate embodiment of upper weight assembly indicated generally by the numeral 22*a* in FIG. 6. In this embodiment, a plate 200 is keyed to the shaft 26 by means of a hub 202. Dowel pins 203 are permanently secured to the plate 200 and provide a place of attachment for the weights 190. The plate 200 extends circumferentially about the shaft 26 and permits the weights 190 to be located circumferentially as desired with respect to the lower eccentric weight assembly 24. This feature greatly enhances the versatility of the machine 10.

Referring to FIGS. 1 and 3, the bowl liner assembly 18 includes a substantially semi-toroidally shaped floor member 210, an outer extension member 212, and an inner extension member 214. The members 210, 212, 214 are separately molded from a relatively stiff lining material such as urethane elastomer having a hardness of about 90 durometers. An adhesive liquid sealant is preferably used between abutting surfaces of the members 210, 212, 214 to enhance the formation of a fluid-tight seal therebetween once these members are clamped together.

The floor member 210 has a rounded inner wall 216 which extends between coplanar outer and inner rim portions 218, 220. The outer rim portion 218 includes a mounting flange 222 which overlies the side wall rim 70. The inner rim portion 220 is engaged by the bottom end surface of the inner extension member 214 when the inner extension member 214 is fixed in place about the center tube 64. The floor member 210 has an outer wall 224 which engages the center tube 64 and the side wall 62 only at locations adjacent the rim portions 218, 220. The outer wall 224 is relieved in areas below the rim portions 218, 220 and makes no other contact with the center tube 64 or the side wall 62. The outer wall 224 has a flat bottom surface 226 which engages the bottom wall 60. The relieved configuration of the outer wall 224 facilitates insertion of the liner member 210 into the annular trough defined by the bottom wall 60, side wall 62, and center tube 64, and facilitates the establishment of an effective clamping action which holds the floor member 210 in place.

The outer extension member 212 has an inner wall 230 which curves inwardly and upwardly from the outer rim portion 218 extending the arcuate curved defined by the inner wall 216. Near the top of the outer extension member 212, the inner wall 230 extends vertically upwardly and terminates in a top surface 232. The outer extension member 212 has a vertically oriented flat wall 233 which is used for a purpose to be described. The outer extension member 212 has a circumferentially extending mounting flange 234 which rests atop the mounting flange 222. A metal ring 236 overlies the mounting flange 234. Threaded fasteners 238 extend through aligned holes formed in the ring 236, the mounting flanges 234, 222, and rim 70 to rigidly connect the liner members 210, 212 to the rim 70. The fasteners 238 clamp the outer extension member 212 downwardly into engagement with the floor member rim portion 218 and cause a fluid-tight seal to be formed between the liner members 210, 212.

The inner extension member 214 has an outer wall 240 which extends vertically upwardly from the inner rim portion 220, breaking the arcuate curve defined by the inner wall 216. The outer wall 240 terminates in a top surface 242. The inner extension member 214 has an enlarged, vertically oriented flat wall 244 (FIGS. 3 and 8) which is used for a purpose to be described. The flat wall 244 is radially aligned with the flat wall 233. A cover 246 rests atop the top surface 242 and closes the open upper end of the center tube 64. If desired, the cover 246 can be perforated in order to permit the bearing assemblies 150, 152 to be cooled better. Threaded fasteners 248 extend through aligned holes formed in the cover 246 and are threaded into holes formed in the tabs 72. The fasteners 248 clamp the inner extension member 214 downwardly into engagement with the floor member rim portion 220 and cause a fluid-tight seal to be formed between the liner members 214, 216.

A cylindrical splash ring 249 extends upwardly from the outer extension member 212 and is secured in place there by a number of threaded fasteners (not shown). The splash ring 249 extends the vertical surface 233 of the inner wall 230 to a height approximately equal to that of the inner extension member 214 and assists in preventing contents of the chamber 20 from being thrown from the chamber 20 during a finishing operation.

A feature of the multi-part liner assembly construction is that it permits individual replacement of the members 210, 212, 214. Since the extension members 212, 214 are subjected to much less abrasive action than the floor member 210, the extension members 212, 214 do not have to be replaced nearly as often as the floor member 210. Moreover, the expense of the inner extension member 214 is reduced compared to prior configurations because of its simplicity. In essence, the inner extension member 214 is an annular ring conforming to the outer surface of the center tube 64. Prior inner extension members 214 extended the arcuate curve defined by the inner wall 216 and were more expensive to manufacture. It has been discovered that it is not necessary to extend the arcuate curve defined by the inner wall 216, and reliable, effective finishing results can be had by employing the simpler, less expensive inner extension member 214. The bolt-together clamping features of the liner assembly wherein two upper liner members are used to securely clamp the lower member provides a system that keeps all three liner members rigidly in place through long periods of service.

Figure 8:
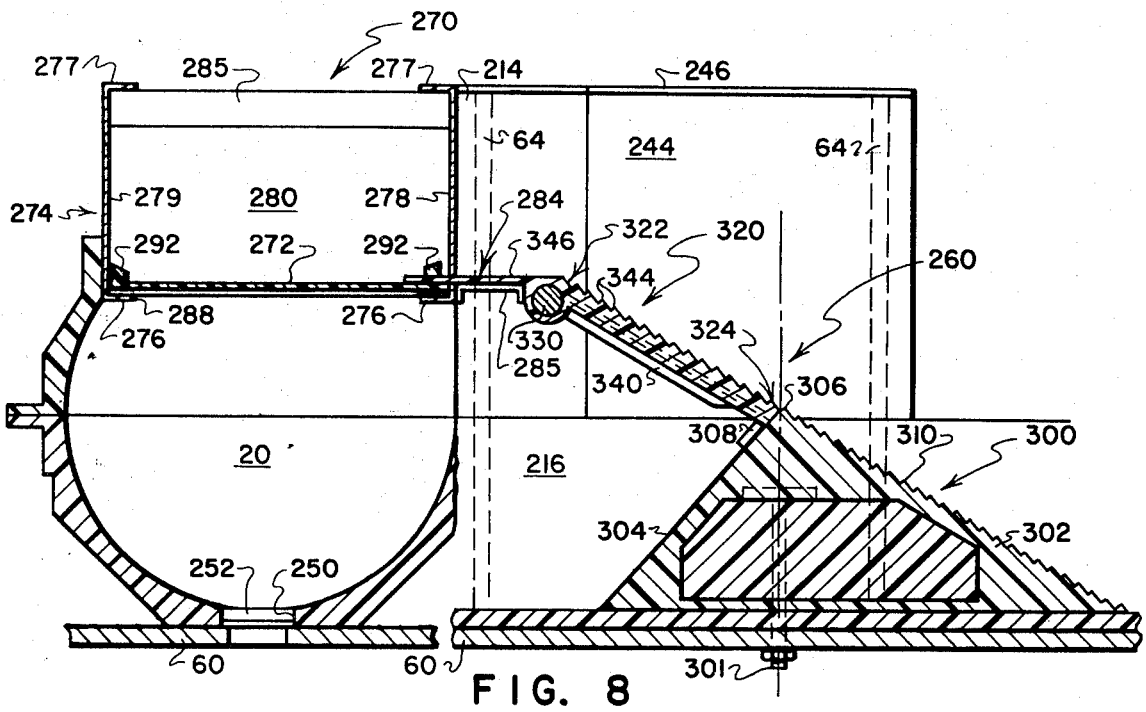
FIG. 8 is a sectional view as seen from planes indicated by a broken line 8—8 in FIG. 3.

Referring to FIGS. 3 and 8, a plurality of openings 250 are formed through the bottom of the floor member 210. The openings 250 are selectively closed by drain plugs 252. In a manner like that explained in the Unloading System Patent, the openings 250 provide a passage for the discharge of fines and liquid from the chamber 60.

Referring to FIG. 3, a large opening 254 also is provided in the bottom of the floor member 210. The opening 254 is selectively closed by a plug assembly 256. As is explained in the elder of the Bowl Machine Suspension System Patents (U.S. Pat. No. 4,091,575), the opening 254 provides a passage for the discharge of media from the chamber 20. Referring to FIG. 2, the side wall **44*e* is set at an angle to the side walls 44*a*, 44*d*. In effect, a corner of the base structure 12 has been shortened. The opening 254 in the floor member 210 is positioned directly above this shortened corner of the base structure 12 and adjacent the side wall 44*e*. By this construction, when media are discharged from the chamber 20, it will be easier for a bucket or other container to be positioned directly beneath the opening 254** so as to catch all of the media being discharged.

In accordance with the preferred practice of the present invention, the machine 10 is provided with an unloading system indicated generally by the numeral 260, as is best seen in FIGS. 3 and 8. The unloading system 260 includes a channel-defining structure 270, a mound-shaped structure 300, and a ramp member 320. The channel-defining structure 270 includes a screen 272 which overlies a portion of the finishing chamber 20. The ramp member 320 is insertable into the chamber 20 and is cooperable with the mound-shaped structure 300 to direct finishing media and finished workpieces from the floor of the chamber 20 upwardly into the channel-defining structure 270, whereupon finishing media drops through the screen 272 back into the chamber 20 and finished workpieces travel across the screen 272 for discharge.

Referring to FIGS. 1, 3, 8, and 11, the channel-defining structure 270 has a housing 274 including a bottom wall 276, a top wall 277, and a pair of upstanding side walls 278, 279 which define an elongate channel 280. A slot 282 is formed in the upstanding wall of the outer extension member 212 to permit the housing 274 to extend therethrough. The housing 274 is of elongate construction having an inner end 284 and an outer end 286. The inner end 284 overlies the chamber 20. A stiffening brace 287 connects the side walls 278, 279 at a location near the inner end 284. The outer end 286 is located radially outwardly from the chamber 20 and can be utilized to direct finished workpieces onto a conveyor (not shown) or into a hopper (not shown). Vertically oriented brackets 287 secure the wall 279 to the machine 10 and are themselves secured in place by certain of the fasteners 238. Referring particularly to FIG. 3, the wall 279 extends the curve of the splash ring 249.

The screen 272 extends from a position near the inner end 284 to a position near the outer end 286. The screen 272 overlies an opening 288 formed through the bottom wall 276. The screen 272 defines a plurality of apertures 290 of predetermined size (only some of which are shown) through which the particular type of finishing media being used in the chamber 20 will pass while permitting finished workpieces to pass thereover for discharge at the outer end 286. The screen includes a retaining means in the form of flanges 292 along its sides. The flanges 292 are inclined at an angle to the horizontal so that media and workpieces always will be directed onto the upper surface of the screen 272. The top wall 277 serves a related function because it prevents media and/or workpieces from being thrown from the channel 280.

The screen 272 is removable and may be replaced readily with screens having apertures 290 of other sizes as may be required to accommodate various sizes and types of finishing media and workpieces. Referring particularly to FIG. 8, the screen 272 is provided with a plurality of openings about its periphery and threaded fasteners 294 extend through the openings and engage openings (not shown) formed in the bottom wall 276. By this construction, the screen 272 is retained in place within the housing 274. Alternatively, retainer strips (not shown) conforming generally to the contour of the screen 272 along its sides can be used to clamp the screen 272 in place. The retainer strips, like the flanges 292, are inclined on their upper surfaces so that workpieces or media thrown about in the channel 280 will fall back onto the screen 272.

The mound-shaped structure 300 is formed from relatively stiff plastics material such as urethane elastomer and may be either bonded to the floor of the chamber 20 or clamped in place by conventional fastening means such as a bolt 301. Referring particularly to FIG. 8, the mound-shaped structure 300 has first and second ramp shaped portions 302, 304 which extend upwardly from the floor of the chamber 20 to a substantially horizontally extending apex 306. As is best seen in FIG. 3, the apex 306 extends substantially radially with respect to the bowl structure 14. The first ramp-shaped portion 302 is located upstream of the apex 306 along the path of movement of finishing media and workpieces in the chamber 20. The second ramp-shaped portion 304 is located downstream of the apex 306 along the media and workpiece travel path.

The flat walls 233, 244 of the outer and inner extension members 212, 214 are positioned on the upstream side and the downstream side of the apex 306. The flat walls 233, 244 extend from a point below the apex 306 to a height about that of the top surface 232. The second ramp-shaped portion 304 also includes a plurality of tabs 308 placed in a line and positioned close to the apex 306. The first ramp-shaped portion 302 includes a plurality of steps 310 on its outer surface. The steps 310 assist in conveying material being processed up the ramp-shaped portion 302.

In normal operation of the machine 10, finishing media and workpieces being finished churn about in the chamber 20 and precess through the chamber 20 along a path indicated generally by arrows 312. During its precession, the mixture of media and workpieces travels upwardly across the first, ramp-shaped portion 302, across the apex 306, and downwardly across the second ramp-shaped portion 304. In many instances, the presence of the mound-shaped structure 300 in the chamber 20 enhances the churning and finishing action imparted to the mixture.

Figure 9:
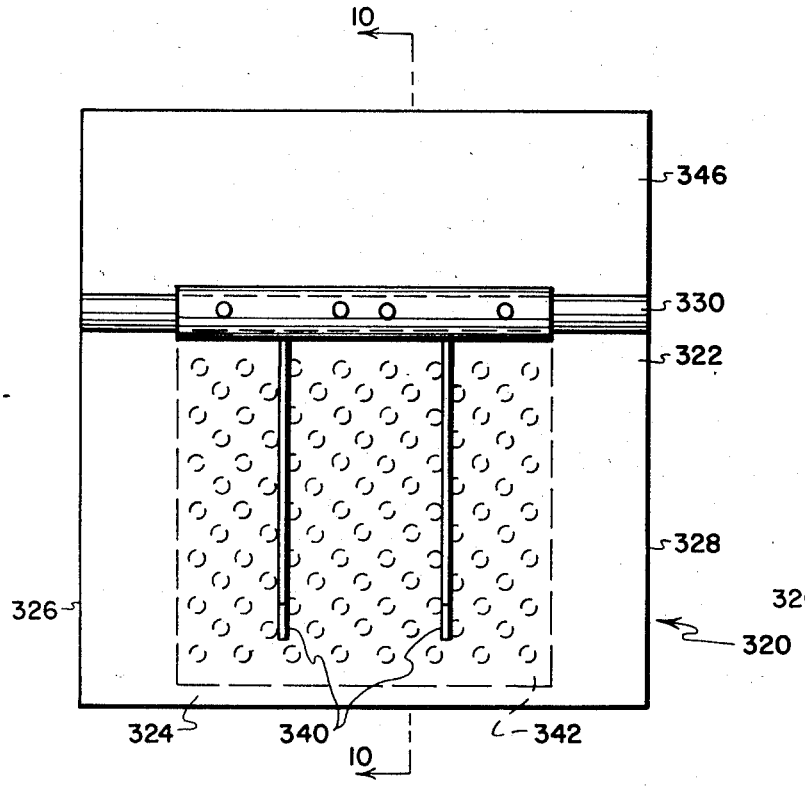
FIG. 9 is an enlarged top plan view of a ramp member utilized in the machine of FIG. 1.
Figure 10:
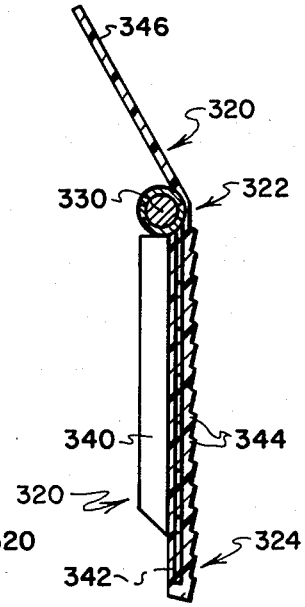
FIG. 10 is a sectional view as seen from a plane indicated by a line 10—10 in FIG. 9.

Referring to FIGS. 9 and 10, the ramp member 320 is a flat structure having opposite end regions 322, 324 and opposite side portions 326, 328. A shaft 330 is secured to the ramp member 320 near the end region 322 and extends completely across the ramp member 320. The shaft 330 is journaled for rotation, one end being supported in an opening 332 formed in the inner extension member 214 and the other end extending through an opening 334 formed in the outer extension member 212. The shaft 330 carries a flexible handle 336 connected securely to its outer end. The handle 336, when rotated upwardly, rests in a clip 338 secured to the metal ring 236. The ramp member 320 includes a pair of spaced reinforcing members 340 secured to the shaft 330 and to a rectangular reinforcing plate 342. The reinforcing members 340 and the reinforcing plate 342 are covered by a urethane covering having a plurality of steps 344. The steps 344 are the same size and shape as the steps 310 and assist in conveying a mixture of media and workpieces from the chamber 20 to the channel 280.

The end region 324 is engageable with the mound-shaped structure 300. The inner side portion 326 has a straight edge adapted to lie closely along the flat wall 244. The outer side portion 328 also has a straight edge adapted to lie closely along the flat wall 233. When the ramp member 320 is in the operating position shown in FIGS. 3 and 8, the inner and outer edges 326, 328 lie closely along and cooperate with the flat wall portions 233, 244, to define a trough for directing finishing media and finished workpieces upwardly from the floor of the chamber 20 into the channel-defining structure 270.

In order to prevent media and workpieces from falling back into the chamber 20 at the interface between the upper end region 322 and the inner end 284 of the housing 274, a flexible flap 346 extends from the ramp member 320 near the end region 322. Regardless of the position of the ramp member 320, the flexible flap 346 prevents media and workpieces from falling back into the chamber 20.

When it is desired to remove media and workpieces from the chamber 20, the handle 336 is lifted from the clip 338 and is pushed downwardly. The end region 324 eventually comes into contact with the tabs 308. This position of the ramp member 320 is illustrated in FIGS. 3 and 8. In order to halt the flow of media and workpieces from the chamber 20, or in order to permit a new mixture of media and workpieces to be processed within the chamber 20, the handle 336 is lifted and flexed into the resting position defined by the clip 338. The foregoing construction is a simple and effective way to control the discharge of media and workpieces from the chamber 20. The flat wall portions 233, 244 permit the ramp member 320 to employ straight side portions 326, 328, thus decreasing the expense of the ramp member 320 and providing a small enough clearance between the ramp member 320 and the flat walls 233, 244 that media and/or workpieces cannot fall back into the chamber 20.

As will be apparent from the foregoing description, the present invention provides a novel and improved bowl-type machine of simple construction which is relatively insensitive to variations in bowl loading and which includes a suspension system that greatly enhances node point stability. The placement of the elastomeric mounts in the nodal plane and the orientation of the mount axes to a point along the central axis above the node point is believed to lead to these advantages. In part, this is thought to be because the mounts are placed both in shear and in compression during operation of the machine. Compared to prior bowl-type machines, the upper eccentric weight assembly permits the vibratory characteristics of the machine to be adjusted much easier, the bowl structure lining is simpler to manufacture, the ramps for removal of media and workpieces are more effective, and the screening action is more effective.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A bowl-type vibratory finishing machine, comprising:

(a) a base structure;

(b) a bowl structure having a central axis and defining a substantially annular chamber adapted to receive finishing media and workpieces to be finished;

(c) a plurality of elastomeric mounts movably supporting the bowl structure on the base structure, each of the mounts having one portion secured to the bowl structure and another portion secured to the base structure, the one and another portions defining an axis for each mount;

(d) drive means for vibrating the bowl structure relative to the base structure to impart a finishing action to contents of the chamber with the bowl structure moving substantially about a nodal point on the central axis; and (e) the elastomeric mounts positioned such that their axes intersect the central axis at a point on one side of the nodal point, the point of intersection being located above the nodal point.

2. The bowl-type vibratory finishing machine of claim 1 wherein the point of intersection of the axes of the elastomeric mounts above the nodal point is located at or near the center of mass of the bowl and finishing media and workpieces carried by the bowl.

3. The bowl-type vibratory finishing machine of claim 1 wherein the elastomeric mounts are arranged such that their axes are inclined the same extent with respect to the central axis.

4. The bowl-type vibratory finishing machine of claim 1 wherein the elastomeric mounts are arranged at equidistant circumferential locations about the central axis.

5. The bowl-type vibratory finishing machine of claim 1 wherein at least three elastomeric mounts are provided.

6. The bowl-type vibratory finishing machine of claim 1 wherein the elastomeric mounts are located at substantially equal distances from the central axis.

7. The bowl-type vibratory finishing machine of claim 1, wherein the nodal point lies in a horizontal plane identified as a nodal plane, and at least a portion of the elastomeric mounts also lie in the nodal plane.

8. The bowl-type vibratory finishing machine of claim 7, wherein the center of mass of each elastomeric mount lies in the nodal plane.

9. A bowl-type vibratory finishing machine, comprising:

(a) a base structure;

(b) a bowl structure having a central axis and defining a substantially annular chamber adapted to receive finishing media and workpieces to be finished;

(c) a plurality of elastomeric mounts movably supporting the bowl structure on the base structure;

(d) drive means for vibrating the bowl structure relative to the base structure substantially about a nodal point located along the central axis, the nodal point lying in a horizontally extending nodal plane; and (e) each of the mounts having one portion secured to the bowl structure and another portion secured to the base structure, the one and another portions defining an axis for each mount, the axis for each mount intersecting the central axis at a common point, the point of intersection being located above the nodal point at a location at or near the center of mass of the bowl and finishing media and workpieces carried by the bowl, and at least a portion of each mount lying in the nodal plane.

10. The bowl-type vibratory finishing machine of claim 9, wherein the bowl structure include a multi-part replaceable liner of resilient material, that portion of the liner defining the upper radially innermost portion of the liner having a vertically oriented straight-sided surface.

11. The bowl-type vibratory finishing machine of claim 9, wherein the drive means includes:

(a) a vertically oriented shaft; and (b) upper and lower eccentric weight assemblies which, upon rotation of the shaft, cause the bowl structure to vibrate, the upper eccentric weight assembly including:

(i) an apertured plate secured to the shaft in a fixed radial position with respect to the shaft; and (ii) a plurality of weights securable to the plate, the weights being positionable at different circumferential locations on the plate to vary the vibratory characteristics of the bowl structure.

12. The bowl-type vibratory finishing machine of claim 11, wherein the plate is in the form of a sector subtending an arc of approximately 90 degrees.

13. The bowl-type vibratory finishing machine of claim 11, wherein the plate is circumferential and the shaft is secured to the plate at or near the center of the plate.

14. The bowl-type vibratory finishing machine of claim 11, further comprising a drive pulley secured to the shaft, the drive pulley lying substantially in the nodal plane.

15. The bowl-type vibratory finishing machine of claim 9, further comprising:

(a) a first ramp-shaped portion disposed within the bowl structure, the first ramp-shaped portion configured such that media and workpieces being processed in the bowl structure advance up the first ramp-shaped portion;

(b) a second ramp-shaped portion disposed within the bowl structure, the second ramp-shaped portion being connected to the first ramp-shaped portion at or near the apex of the first ramp-shaped portion and configured such that media and workpieces reaching the apex of the first ramp-shaped portion pass down the second ramp-shaped portion; and (c) a displaceable ramp member, the ramp member comprising a generally flat plate hinged at one end, the ramp member being movable into an unloading position wherein that end of the ramp member spaced from the hinge contacts the first and second ramp portions near their interface, the ramp member configured such that, when the ramp member is in the unloading position, media and workpieces will advance up the first ramp portion and continue up the ramp member.

16. The bowl-type vibratory finishing machine of claim 15, wherein the ramp member is rectangular and is pivoted adjacent straight-sided wall surfaces included as part of the bowl structure.

17. The bowl-type vibratory finishing machine of claim 15, wherein the hinged end of the ramp member is positioned adjacent a channel-defining structure carried by the bowl structure.

18. The bowl-type vibratory finishing machine of claim 17, wherein the channel-defining structure includes a housing extending outwardly of the bowl structure, the housing including an opening in a bottom wall and a screen positioned in the housing, the screen effecting separation of media and workpieces advancing across the screen.

19. The bowl-type vibratory finishing machine of claim 17, wherein:

(a) each side wall of the bowl structure has portions which include a flat surface oriented vertically, the flat surfaces being in radial alignment with each other; and (b) the inner and outer side portions of the ramp member are configured to cooperate with the flat wall surfaces of the side walls to create a trough through which media and workpieces can be conveyed.

20. The bowl-type vibratory finishing machine of claim 17, wherein the ramp member comprises a generally rectangular flat plate to which a shaft is secured at one end, the shaft and the plate being covered with a layer of synthetic material, the synthetic material extending beyond the plate and the shaft to define a flap, the flap providing an interface between the upper surface of the ramp and the channel-defining structure.

21. The bowl-type vibratory finishing machine of claim 15, wherein the first ramp-shaped portion and the ramp member include a plurality of laterally extending steps formed on their upper surfaces, the steps serving to propel media and workpieces upwardly, and restrain backward movement of media and workpieces.

22. The bowl-type vibratory finishing machine of claim 15, wherein:

(a) the ramp is hinged by a shaft extending radially of the machine, the inner end of the shaft being supported for rotation adjacent the inner side wall of the bowl structure, the outer end of the shaft passing through an opening in the outer side wall of the bowl structure; and (b) a flexible handle is secured to the outer end of the shaft, the handle being engageable with a locking clip for supporting the handle, and hence the plate, in a raised position relative to the first and second ramp-shaped portions.

23. The bowl-type vibratory finishing machine of claim 9, further comprising:

(a) a channel-defining structure carried by the bowl structure, the channel-defining structure extending outwardly of the bowl structure;

(b) a housing included as part of the channel-defining structure, the housing having vertically oriented, spaced side walls connected by a horizontally extending bottom wall;

(c) an opening in the bottom wall overlying the bowl structure;

(d) a screen having a generally flat upper surface being positioned in the housing, the screen overlying the opening in the bottom wall; and (e) retaining means located at the edges of the screen, the retaining means serving to hold the screen in place within the housing and to constantly urge media and workpieces onto the upper surface of the screen.

24. The bowl-type vibratory finishing machine of claim 23, wherein the retaining means comprises a raised strip secured to the screen at each side of the screen, the upper surface of the strips being inclined relative to the horizontal, the angle of inclination being such that media and workpieces are directed onto the upper surface of the screen.

25. The bowl-type vibratory finishing machine of claim 24, wherein the retaining means are provided with a plurality of vertically extending openings through which threaded fasteners extend, the threaded fasteners thereby securing the retaining strips and the screen within the housing.

26. A bowl-type vibratory finishing machine, comprising:

(a) a base structure;

(b) a bowl structure having a central axis and defining a substantially annular chamber adapted to receive finishing media and workpieces to be finished, the chamber including a replaceable liner, the upper, radially innermost portion of which includes a vertically oriented straight-sided wall, each side wall of the bowl structure having portions which include a flat surface oriented vertically, the flat surfaces being in radial alignment with each other, the chamber also including:

(i) a first ramp-shaped portion disposed along its bottom, the first ramp-shaped portion configured such that media and workpieces being processed in the bowl structure advance up the first ramp-shaped portion;

(ii) a second ramp-shaped portion disposed adjacent the first ramp-shaped portion, the second ramp-shaped portion being connected to the first ramp-shaped portion at or near the apex of the first ramp-shaped portion and configured such that media and workpieces reaching the apex of the first ramp-shaped portion pass down the second ramp-shaped portion; and (iii) a displaceable ramp member, the ramp member comprising a generally flat plate hinged at one end, the ramp member being movable into an unloading position wherein that end of the ramp member spaced from the hinge contacts the first and second ramp portions near their interface, the ramp member configured such that, when the ramp member is in the unloading position, media and workpieces will advance up the first ramp portion and continue up the ramp member, the ramp member including straight-sided edge portions disposed adjacent the vertically oriented flat surfaces included as part of each side wall;

(c) a plurality of elastomeric mounts movably supporting the bowl structure on the base structure, each of the mounts having one portion secured to the bowl structure and another portion secured to the base structure, the one and another portions defining an axis for each mount, the bowl structure being movable substantially about a nodal point on the central axis, the elastomeric mounts positioned such that their axes intersect the central axis at a point above the nodal point, the nodal point lying in a horizontal plane identified as a nodal plane, and at least a portion of the elastomeric mounts also lying in the nodal plane;

(d) drive means for vibrating the bowl structure relative to the base structure to impart a finishing action to contents of the chamber, the drive means including a vertically oriented shaft, upper and lower eccentric weight assemblies which, upon rotation of the shaft, cause the bowl structure to vibrate, the upper eccentric weight assembly including an apertured plate secured to the shaft in a fixed radial position with respect to the shaft, and a plurality of weights securable to the plate, the weights being positionable at different circumferential locations on the plate to vary the vibratory characteristics of the bowl structure, the drive means also including a drive pulley secured to the shaft, the drive pulley lying substantially in the nodal plane; and (e) an unloading structure for removing finished workpieces from the chamber, the unloading structure including a housing extending outwardly of the bowl structure, the housing being spaced above the chamber, the housing including an opening in a bottom wall and having a screen positioned in the housing, the screen effecting separation of media and workpieces advancing across the screen, an inner end of the housing being positioned adjacent the displaceable ramp member such that when the ramp member is in the unloading position, media and workpieces advancing up the ramp member will be directed onto the screen, the ramp member including a flexible flap extending across the interface between the upper surface of the ramp and the housing, and the unloading structure including a retaining means to secure the screen within the housing, the retaining means being located at the edges of the screen, the retaining means comprising a raised strip secured to the screen at each side of the screen, the upper surface of the strips being inclined relative to the horizontal, the angle of inclination being such that media and workpieces always are directed onto the upper surface of the screen.

27. The bowl-type vibratory finishing machine of claim 26, wherein the first ramp-shaped portion and the displaceable ramp member include on their outer surfaces a covering of synthetic material, the outer surfaces having a plurality of laterally extending steps formed thereon, the steps serving to propel media and workpieces upwardly, and to restrain backward displacement of media and workpieces.

28. The bowl-type vibratory finishing machine of claim 26, wherein the hinged mounting for the ramp member includes a shaft extending radially of the machine, the inner end of the shaft being supported for rotation adjacent the inner side wall of the bowl structure, the outer end of the shaft passing through an opening in the outer side wall of the bowl structure, and a flexible handle being secured to the outer end of the shaft, the handle being engageable with a locking clip for supporting the handle, and hence the ramp member, in a raised position relative to the first and second ramp-shaped portions.

29. The bowl-type vibratory finishing machine of claim 26, wherein the center of mass of each elastomeric mount lies in the nodal plane, and wherein at least three elastomeric mounts are provided, the mounts being arranged at equidistant circumferential locations about the central axis.

30. The bowl-type vibratory finishing machine of claim 26, wherein the apertured plate included as part of the upper eccentric weight assembly is in the form of a sector subtending an arc of approximately 90 degrees, the sector having a hub by which the sector is secured to the shaft in a fixed radial position.

31. A bowl-type vibratory finishing machine, comprising:

(a) a base structure;

(b) a bowl structure having a central axis and defining a substantially annular chamber adapted to receive finishing media and workpieces to be finished;

(c) a plurality of elastomeric mounts movably supporting the bowl structure on the base structure, each of the mounts having one portion secured to the bowl structure and another portion secured to the base structure, the one and another portions defining an axis for each mount;

(d) drive means for vibrating the bowl structure relative to the base structure to impart a finishing action to contents of the chamber with the bowl structure moving substantially about a nodal point on the central axis; and (e) all of the elastomeric mounts being positioned such that the axes intersect the central axis at a common point, the common point being spaced from the nodal point.

32. The bowl-type vibratory finishing machine of claim 31 wherein the point of intersection of the axes of the elastomeric mounts is located above the nodal point.

33. The bowl-type vibratory finishing machine of claim 31, wherein the nodal point lies in a horizontal plane identified as a nodal plane, and at least a portion of each of the elastomeric mounts also lies in the nodal plane.

34. The bowl-type vibratory finishing machine of claim 31, wherein the point of intersection of the axes of the elastomeric mounts is located at or near the center of mass of the bowl and finishing media and workpieces carried by the bowl.

* * * * *